United States Patent [19]

Manas

[11] Patent Number: 4,883,251

[45] Date of Patent: Nov. 28, 1989

[54] CONTAINER FOR MAKING ICE CUBES

[76] Inventor: Jorge F. Manas, c/Espronceda, 310-318, 08027Barcelona, Spain

[21] Appl. No.: 273,182

[22] Filed: Nov. 15, 1988

Related U.S. Application Data

[63] Continuation of Ser. No. 59,968, Jun. 9, 1987, abandoned.

[51] Int. Cl.[4] ..... F25C 1/24; B65D 1/04

[52] U.S. Cl. ..... 249/53 R; 206/509; 215/1 C; 215/6; 249/110; 249/121; 249/126; 249/127; 249/130; D15/90

[58] Field of Search ..... 249/53 R, 119, 121, 249/126, 127, 129, 130, 132, 110; 215/1 C, 6, 10; 206/509; D15/90

[56] References Cited

U.S. PATENT DOCUMENTS

| | | | |
|---|---|---|---|
| D. 281,882 | 12/1985 | Prommer | D15/90 |
| 3,135,101 | 6/1964 | Nigro | 249/127 |
| 3,306,567 | 2/1967 | Frei, Sr. | 249/53 |
| 3,352,528 | 11/1967 | Bernstrom et al. | 249/126 |
| 3,443,785 | 5/1969 | Ewers | 249/53 |
| 4,432,529 | 2/1984 | McMillan | 249/121 |

FOREIGN PATENT DOCUMENTS

| | | | |
|---|---|---|---|
| 2500230 | 9/1975 | Fed. Rep. of Germany | 249/127 |

*Primary Examiner*—James C. Housel

*Attorney, Agent, or Firm*—Fleit, Jacobson, Cohn, Price, Holman & Stern

[57] ABSTRACT

A container for making ice cubes having a generally prismatic hollow configuration, a front side of which includes rows of truncated pyramidal cavities, the back wall having mutually perpendicular stacking ribs for mating with the cavities of a juxtaposed container, and the top wall having a fill and emptying aperture closed by a screw cap or stopper. The container also has a fill marking on one of the sides and flow channels between the cavities.

2 Claims, 2 Drawing Sheets

CONTAINER FOR MAKING ICE CUBES

Figure 1:
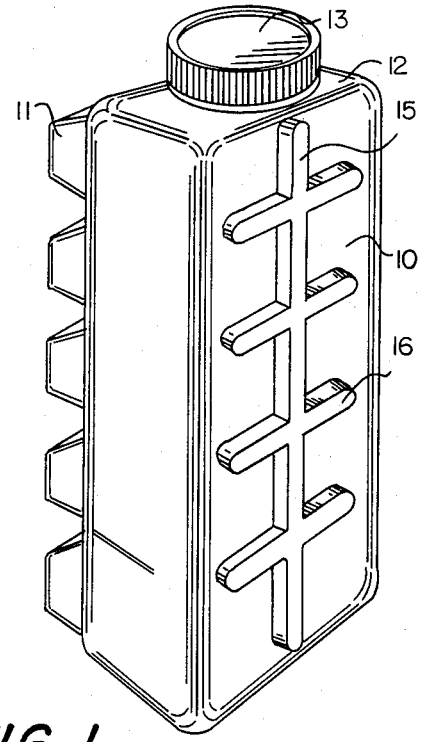
Figure 2:
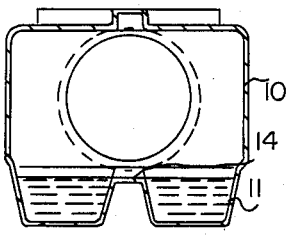
Figure 3:
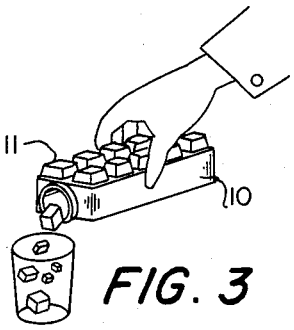
Figure 4:
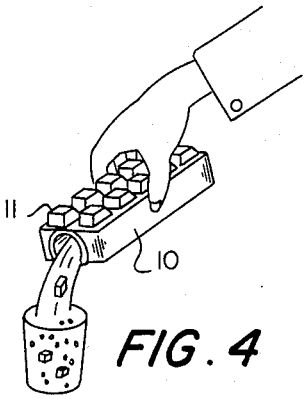
Figure 5:
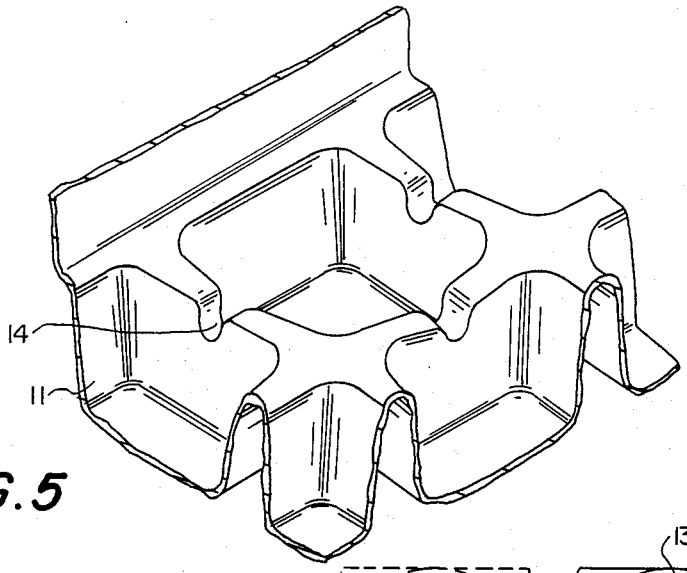
Figure 6:
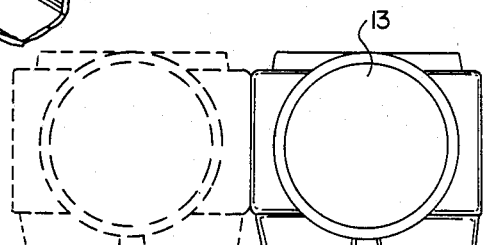
Figure 7:
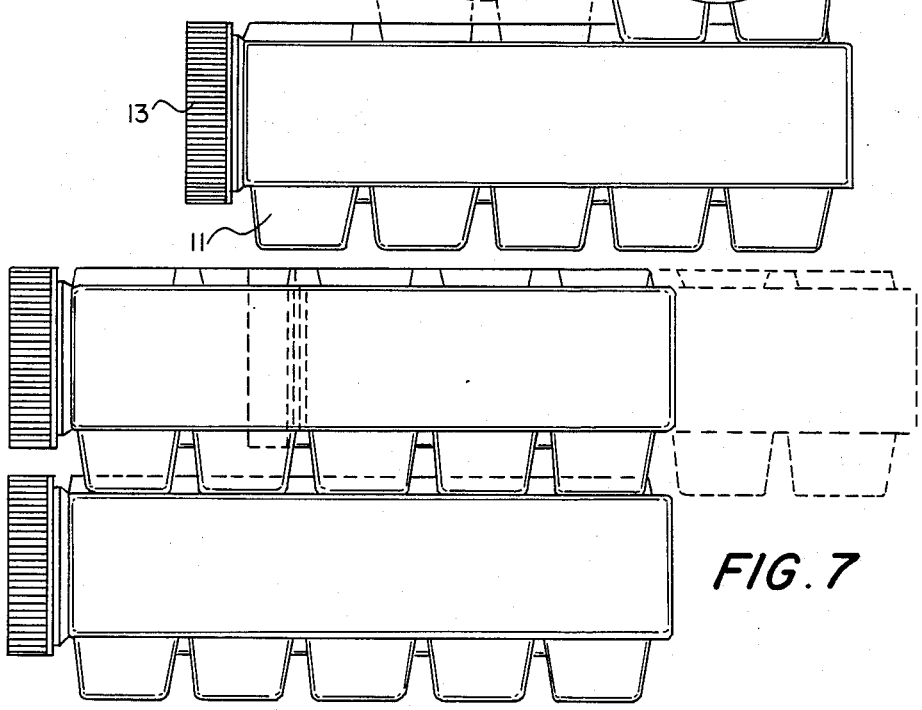

This is a continuation of application Ser. No. 059,968, filed June 9, 1987 now abandoned.

This invention relates, as stated in the title thereof, to a "CONTAINER FOR MAKING ICE CUBES" the new construction, shaping and design features of which fulfil the mission for which it has been specifically devised with maximum reliability and efficiency.

As is known, the currently used containers for making ice cubes are completely open containers, which implies the risk that when the water is poured in to become ice after introduction in the freezer, during movement the water or liquid deposited in the container is often involuntarily split.

Also, since these containers are open, it may happen that, depending on the type of foodstuff inside the refrigerator or freezer, if such foodstuffs give off odours, such ice cubes may be impregnated with such odours, which may be highly troublesome for the user.

So as to overcome all these drawbacks, the container according to the invention has been devised, and is constituted basically by a container having a generally prismatic configuration with the peculiarity that a series of cavities of truncated pyramidal form have been formed on one of the side walls, the upper wall of such container being provided with a neck having a screw thread of the same pitch as the one formed on the inner surface of the corresponding stopper, allowing such container to be fully closed.

With such configuration, it is sufficient to pour in the necessary and sufficient amount of water to fill all the truncated pyramidal cavities so that, when such container is placed in a horizontal position, resting on the bases of the said truncated pyramidal cavities, the water previously poured into this container is uniformly distributed, such amount of water being indicated by a conventional mark made on one of the side walls of the container, whereby when the stopper is screwed in place and the container is located as indicated in a horizontal position, although it is handled roughly there is no risk of the water contained therein falling accidentally from the interior of the container, it being avoided in turn that during the period of forming the cubes as well as during the period that these are located inside the corresponding refrigerator, the water may absorb the odours from other foodstuffs which may be stored.

In turn it has been contemplated that all the truncated pyramidal cavities are interconnected thanks to the existence of channels, whereby the water poured in will equally fill all these cavities.

Furthermore, it has been contemplated that on the wall opposite the truncated pyramidal cavities of this container has been provided with ribs located in such a way that, thanks to their dimensions, they are located between the truncated pyramidal cavities, there being attained with this that they may be stacked at the same time as with such stacking they are held together thanks precisely to such ribs.

Other details and features of this model will become evident during the following description, wherein reference is made to the drawings accompanying this specification in which, somewhat schematically, there has been represented the preferred details. These details are given as an example, with reference to one possible practical embodiment, but it is not limited to the details therein given; therefore this description should be considered from an illustrative point of view without limitations of any kind.

FIG. No. 1 is a perspective view wherein the container of this Utility Model may be seen.

FIG. No. 2 is a cross sectional view in which the container has been placed in a front position.

FIG. No. 3 is a detail in which there may be seen schematically how the cubes come out once they have been formed inside the container of the invention.

FIG. No. 4 is a further detail showing how the cubes already formed may fall from the interior of the container in which there has previously been poured any other liquid which it is wanted to chill by contact with the cubes formed inside such container.

FIG. No. 5 is a detail of the channels interconnecting the truncated pyramidal protuberances.

FIG. No. 6 is a view in which the stacking of several containers may be seen.

FIG. No. 7 is a view similar to FIG. No. 6 showing an alternative container stacking mode.

In the attached figures it may be seen that this container is formed with a generally hollowed prismatic configuration (10) such that on one of the sides of larger area there has been provided a series of cavities (11) having a truncated pyramidal configuration.

Furthermore, the upper wall (12) of this container is provided with a neck on which there has been formed a conventional thread which mates with the one formed on the inner surface of the stopper (13), thereby allowing a perfect sealing of the said container to be achieved.

Logically when it is wished to pour in the corresponding water for the formation of cubes, it is sufficient first to remove the stopper (13) and then pour in the corresponding water or liquid in such an amount as corresponds to the volume of the different cavities (11), which measure is obviously marked on at least one of the side surfaces of the container in question.

Obviously the amount of water will be perfectly distributed because there has been contemplated the existence of a channel (14) which interconnects the said cavities (11) thereby achieving a uniform distribution of the water in all of them.

Thereafter, after replacing the stopper (13) it may be moved and handled without any risk of causing the spilling of the liquid contained therein, and at the same time, on being completely closed, the liquid contained in the interior thereof is prevented from absorbing odours and aromas from other foodstuffs which may be located in the same refrigerator or freezer.

Likewise, the existence of ribs (15) and (16) disposed in cross form has been contemplated, such that they are located in the projection of the spaces existing between the cavities (11), thereby allowing a perfect stacking of several containers, holding them in turn whatever the direction in which they are placed.

Obviously to remove the cubes, it is sufficient to unscrew the stopper (13) so as subsequently to press the smaller base corresponding to each of the truncated pyramidal portions (11), whereby the corresponding cube is caused to be ejected from its cavity and expelled through the mouth to the outside, the exit of such cube being perfectly guided by the rib (15).

Furthermore, thanks also to the shape of this container, after formation of the cubes, any liquid may be poured into the interior thereof will be immediately cooled on making contact with the cubes, with the possibility of being served and, if so desired, mixed therewith.

A further feature is the fact that the side walls are completely flat allowing them to be silkscreen printed with great ease, which is of great importance since it allows any desired instructions and adverts be illustrated.

It will be understood after seeing the drawings and the explanation given thereof that the present invention provides a simple effective construction which may be embodied with great ease, constituting without any doubt an industrial result.

It is stated, for the pertinent effects, that all those variations and modifications of detail which the circumstances and practice may advise, may be introduced in the object of this invention, provided that with the variants that are introduced, the essence as summarized in the following CLAIMS is not altered or modified.

I claim:

1. Apparatus for making ice cubes comprising a generally prismatic one-piece self-supporting container of hollow configuration, the container having a base wall, front and back walls, opposite side walls, and a top wall, the front and back walls being wider than the side walls, the front wall being formed with rows of outwardly directed ice-forming cavities, each cavity having the shape of a truncated pyramid to allow an ice cube to be released therefrom by external pressure, inter-cavity walls with channels therein providing liquid flow communication between the cavities, a combination filling and emptying aperture in the top wall dimensioned to allow ice cubes released from the respective cavities to be discharged therethrough, a fill marking on one of the front, back and side walls to indicate a fill level for the ice-forming cavities when the container is oriented with said aperture facing upwards, and mutually perpendicular external stacking ribs on the back wall enabling a plurality of said containers to be stacked selectively in parallel and in mutually perpendicular relation, the apparatus further including a closure member for said aperture, the stacking ribs including an elongate spine extending substantially the entire length of the back wall and lateral ribs spaced along and extending outwardly from opposite sides of said spine.

2. Apparatus as defined in claim 1, wherein said aperture is defined by a threaded neck and the closure member is a screw cap fitting on the neck.

* * * * *